US012264602B2

(12) United States Patent
Hübner et al.

(10) Patent No.: US 12,264,602 B2
(45) Date of Patent: Apr. 1, 2025

(54) ROCKER ARM ASSEMBLY WITH ROTATION-LOCKING MECHANISM

(71) Applicant: Eaton Intelligent Power Limited, Dublin (IE)

(72) Inventors: Zdeněk Hübner, Horoušánky (CZ); Georgios Moraitis, Prague (CZ); Mirko Guaschino, Monferrato (IT); Peter Terna, Stropkov (SK)

(73) Assignee: Eaton Intelligent Power Limited, Dublin (IE)

( * ) Notice: Subject to any disclaimer, the term of this patent is extended or adjusted under 35 U.S.C. 154(b) by 0 days.

(21) Appl. No.: 18/560,983

(22) PCT Filed: May 19, 2021

(86) PCT No.: PCT/EP2021/063326
§ 371 (c)(1),
(2) Date: Nov. 15, 2023

(87) PCT Pub. No.: WO2022/242850
PCT Pub. Date: Nov. 24, 2022

(65) Prior Publication Data

US 2024/0254899 A1 Aug. 1, 2024

(51) Int. Cl.
*F01L 1/18* (2006.01)
*F01L 1/24* (2006.01)

(52) U.S. Cl.
CPC ..... *F01L 1/182* (2013.01); *F01L 1/2411* (2013.01); *F01L 2001/2444* (2013.01)

(58) Field of Classification Search
CPC ... F01L 1/18; F01L 1/181; F01L 1/182; F01L 1/267; F01L 1/2411; F01L 2001/2444;
(Continued)

(56) References Cited

U.S. PATENT DOCUMENTS 5,645,031 A * 7/1997 Meneely ..... F01L 13/065 123/321
7,171,930 B2 * 2/2007 Keel ..... F01L 1/181 74/559
10,781,729 B1 * 9/2020 Foster ..... F01L 13/0021

FOREIGN PATENT DOCUMENTS

CN 104454067 A * 3/2015 ..... F01L 13/00
CN 204492913 U 7/2015
(Continued)

OTHER PUBLICATIONS

International Search Report issued in corresponding application No. PCT/EP2021/063326 dated Feb. 7, 2022, 3 pages.
(Continued)

*Primary Examiner* — Loren C Edwards
(74) *Attorney, Agent, or Firm* — Meunier Carlin & Curfman LLC

(57) ABSTRACT

A rocker arm assembly can comprise a rocker arm. A rocker shaft comprises a channel and an oil path enclosed in the rocker shaft. The oil path is configured to supply hydraulic pressure within the rocker shaft to the channel. Rotation-locking mechanism comprises a locking pin or pressure pin configured to slide in the channel. The oil path is configured to supply oil pressure to the locking pin or pressure pin within the rocker shaft. The locking pin can be configured to slide in the channel between a locked position, where the locking pin abuts a groove, and an unlocked position, where the locking pin is withdrawn into the channel. Or, a locking pin can be configured to slide in the rocker arm between a locked position abutting the locking groove and an unlocked position where the locking pin is withdrawn into the rocker arm.

7 Claims, 4 Drawing Sheets

(58) Field of Classification Search
CPC . F01L 13/0005; F01L 2013/001; F01L 13/06; F01L 13/065; F01L 13/08
See application file for complete search history.

(56) References Cited

FOREIGN PATENT DOCUMENTS

| | | | | | |
|---|---|---|---|---|---|
| CN | 104819022 | A | * | 8/2015 | ..... F01L 1/183 |
| CN | 104454067 | B | | 1/2018 | |
| JP | 2864399 | B2 | | 3/1999 | |

OTHER PUBLICATIONS

Written Opinion issued in corresponding application No. PCT/EP2021/063326 dated Feb. 7, 2022, 6 pages.

* cited by examiner

ROCKER ARM ASSEMBLY WITH ROTATION-LOCKING MECHANISM

CROSS-REFERENCE TO RELATED APPLICATIONS

This is a National Stage application of PCT international application PCT/EP2021/063326 filed on May 19, 2021, which is incorporated herein by reference in its entirety.

FIELD

This application provides a rocker arm assembly with a rotation-locking mechanism. A rocker arm locks and unlocks relative to a rocker shaft.

BACKGROUND

Hydraulic systems present challenges in valvetrains. Typically, an oil pump must pump and pressurize oil to actuate hydraulic devices. This can cause a delay during start-up. But, it is desired to have variable valve actuation ("VVA") during start-up and other periods when the pump power supply could result in low pump pressure, such as coasting or idling.

Hydraulic systems also present challenges for containing and directing the pressurized oil. Actuation paths, return paths, controlled orifices, and fluid-filling compartments are all design challenges.

Rocker arms with hydraulic challenges include CN204492913U & CN104454067A. These rocker arms have large fluid compartments 260, 270 that can result in supply difficulties, as a large amount of fluid is needed to fill the compartments up and down the valvetrain. The large supply requires a bulky sump and long spool-up times to reach desired pressurization. Also, large leakage paths around the large compartments can lead to additional pumping burdens to keep up with the leakage.

SUMMARY

The methods and devices disclosed herein overcome the above disadvantages and improves the art by way of a rocker arm assembly that can comprise a rocker arm. A rocker shaft comprises a channel and an oil path enclosed in the rocker shaft. The oil path is configured to supply hydraulic pressure within the rocker shaft to the channel. Rotation-locking mechanism comprises a locking pin or pressure pin configured to slide in the channel. The oil path is configured to supply oil pressure to the locking pin or pressure pin within the rocker shaft.

The locking pin can be configured to slide in the channel between a locked position, where the locking pin abuts a groove, and an unlocked position, where the locking pin is withdrawn into the channel.

Or, a locking pin can be configured to slide in the rocker arm between a locked position abutting the locking groove and an unlocked position where the locking pin is withdrawn into the rocker arm.

Additional objects and advantages will be set forth in part in the description which follows, and in part will be obvious from the description, or may be learned by practice of the disclosure. The objects and advantages will also be realized and attained by means of the elements and combinations particularly pointed out in the appended claims.

It is to be understood that both the foregoing general description and the following detailed description are exemplary and explanatory only and are not restrictive of the claimed invention.

DETAILED DESCRIPTION

Figure 1A:
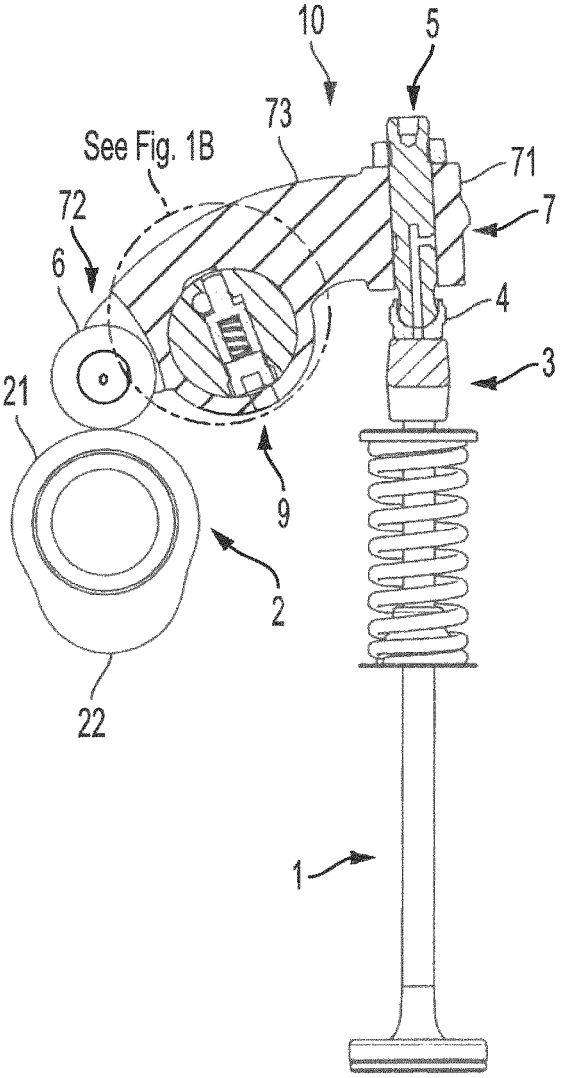
FIGS. 1A-1D illustrate a first rotation-locking mechanism for a first rocker arm assembly.

Reference will now be made in detail to the examples which are illustrated in the accompanying drawings. Wherever possible, the same reference numbers will be used throughout the drawings to refer to the same or like parts. Directional references such as "up" and "down" are for ease of reference to the figures.

Rocker arm assemblies 10, 11 and rocker arms 7, 17 can be used in a variety of vehicles, but are particularly suitable for providing variable valve actuation ("VVA") on heavy-duty engines. VVA techniques such as early opening or extended closing can enable fuel economy benefits during operation. One type of VVA discussed herein is Cylinder De-Compression ("CDC") mode. The rotation-locking mechanisms 9, 19 herein enable Cylinder De-Compression mode for Internal Combustion Engines. This CDC mode can be used to prevent one or more exhaust valve 1 from closing when an engine is being shut down. CDC mode can also keep one or more valves 1 open when the engine is being turned on. Other VVA techniques can be enabled on demand by extending or retracting a locking pin 91, 201 to lock or release the rocker arm 7, 17 and thereby prevent or enable the rocker arm to get below a certain lift.

Combustion engines are forced to reduce fuel consumption and exhaust emissions. One of the possible ways is to use a Cylinder De-Compression ("CDC") system in the engine's valvetrain. CDC mode at start-up, shut-down, or coast decreases pressure in combustion cylinders, and therefore reduces the required torque to spin a crank shaft. That is beneficial in numerous usages, for example, in Start/Stop systems, a lower power consumption and lower vibration is experienced during repeated starts and stops. In hybrid drivetrains, there can be seamless transitions between an internal combustion engine ("ICE") and an electric motor ("e-motor"). When coasting an ICE vehicle, it is possible to provide a substitution of Cylinder De-Activation ("CDA") for lower fuel consumption during low load regimes.

A usual adoption problem of a VVA system is the required design changes on the engine valvetrain. Other solutions increase costs for OEMs and require structural changes to the engine compartment that impact packaging. However, the rocker arms 7, 17 proposed herein cause little change to the packaging of the engine compartment. The OEM can add hydraulic control to the rocker shaft 8, 18, but does not add much, if any, bulk over the rocker arm. Or, the OEM uses existing lubrication or hydraulic lash pathways to control locking pin 91 or to control a pressure pin 191 and locking pin 201. The CDC system is integrated in the engine rocker arms 7, 17 and rocker-shafts 8, 18 and therefore reduces OEM's costs over VVA systems requiring additional hardware like towers and rails. Minimal oil control design change by the OEM is needed to achieve the fuel benefits of CDC mode. But, rocker arm carriers or engine head parts do not need adjustment.

When an Internal Combustion Engine is being turned on it needs to reach a certain rotations per minute ("RPM") of the crankshaft for which the combustion is stable and noise, vibration, and harshness ("NVH") is acceptable. This is generally referred as idle. In order to get an engine to the idle RPM, a starter motor such as an Electro-Motor can be used. When the starter motor spins the crankshaft (and subsequently other components) it needs to overcome various forces. One of the main forces it needs to overcome is force due to compression of air in the cylinders. Compression in the cylinders occurs due to the fact that exhaust valves are closed during a "compression stroke" of the reciprocating pistons affiliated with the crankshaft. This is desired during combustion. However, when the engine is being started it forces the electro-motor to spend a great amount of energy to overcome the compression of the pistons as they reciprocate up and down in the cylinders. This puts a load on the electro-motor and supporting systems. This can cause the electro-motor to be over-dimensioned & expensive.

Cylinder De-Compression mode disclosed herein eliminates the load on the electro-motor caused by the compression stroke by keeping the one or more exhaust valves 1 open during the initial (start-up) phase. This prevents the compression during the compression stroke. And, this does not detract from exhaust valve closing during the combustion phase. This makes the combustion phase as efficient as possible.

Another benefit of Cylinder De-Compression mode is achieved as the engine approaches zero RPM (when it is being shut down). A compression stroke during shut down causes unfavorable torsional vibrations and worsens the NVH as well as the comfort of the driver. Having the valves 1 open during this shut down phase significantly reduces those unfavorable torsional vibrations.

Having a cylinder decompression system also allows quicker start-up of the engine. CDC mode enables a Start-Stop system that shuts the engine off for short periods of time when not needed (e.g.: in traffic queue, waiting for traffic light, etc.). "Coasting" and "platooning" also benefit from CDC mode. Preventing compression during the compression stroke decreases losses of the ICE and enables a longer coast distance. A platoon of vehicles benefits from having less resistance to drafting.

The rotation-locking mechanisms 9, 19 function to prevent a rocker arm 7, 17 from returning to the lift position nominally provided when the cam 2 is back on base circle 21. The rotation-locking mechanism 9, 19 locks the rocker arm 7, 17 to keep the one or more valves 1 open.

In rocker arm systems 10, 11, a cam 2 rotates to actuate a cam end 72, 172 of the rocker arm 7, 17. Cam end 72, 172 can comprise a roller bearing 6 or a tappet that rides on the cam 2. Two exemplary profiles are included on the cam 2, though additional lobes for additional profiles can be included. Base circle 21 is a cam lobe profile that nominally allows the rocker arm 7, 17 to pivot on the rocker shaft 8, 18 to close the one or more valve 1. "Nominal" can mean "normal" in the parlance of valve lift profiles. "Nominal" can be a baseline operation with full valve closure, such as a compression or combustion mode of the ICE. Lift mode 22 is a cam lobe profile that nominally allows the rocker arm 7, 17 to pivot on the rocker shaft 8, 18 to open the one or more valve 1. Lift mode 22 can release charge or exhaust, or can intake charge or exhaust, according to the combustion or other VVA mode implemented (internal exhaust gas recirculation, reverse-breathing, re-breathing, etc.). The rotation-locking mechanism 9, 19 interrupts the return of the rocker arm 7, 17 from a normally open lift position to the normally closed position, thereby keeping the valve ajar until the rotation-locking mechanism 9, 19 returns to an unlocked position.

Cam actuation at the cam end 72, 172 translates to rotation of the rocker arm body 73, 173 around the rocker shaft 8, 18. The valve end 71 lifts or lowers according to the base circle 21 or lift mode 22 conveyed to the rocker arm 7, 17. Rocker arm system 10, 11 can comprise a variety of optional and alternative features, such as an actuation capsule 5 for purposes such as hydraulic or mechanical lash adjustment, cylinder deactivation, engine braking, early or late valve opening or closing, among other options. An interface, such as elephant foot (e-foot) 4 can be affiliated with the valve end 71. A valve bridge 3 can receive the valve lift profile from the valve end and transfer the valve lift profile to one or more valves 1. Valve 1 can comprise customary features such as valve stem, valve head, return spring, among other features. Additional rocker arms can be paired with rocker arm 7, 17 for actuation against the valve or valve bridge, as by having an actuation platform or extension or as by having another force transfer location on the valve bridge.

Rocker arm body 73, 173 and rocker shaft 8, 18 can be modified to include a rotation-locking mechanism 9, 19. Oil pressure in the rocker shaft 8, 18 can be controlled by an oil pump linked with the crankshaft. As an RPM of the crankshaft increases so does the oil pressure increase; and, as the RPM of the crankshaft decreases, so does the oil pressure decrease. So, there is a link between RPM and oil pressure. The rotation-locking mechanism 9, 19 takes advantage of this oil pressure relationship by keeping locking pin 91, 201 extended by default with a spring 93, 211 when the engine is off or when the engine is of insufficient RPMs to supply a counterpressure (no or not enough oil pressure) against the spring force of spring 93, 211 (ex.: coasting, start-up, shut-down).

The rotation-locking mechanism 9, 19 is deactivated, also called unlocked, when the locking pin 91, 201 is retracted. This occurs once the engine crankshaft reaches a predetermined RPM and the oil pressure of the system reaches a predetermined value. This predetermined value of oil pressure will act on the locking pin 91, 201 and compress the spring 93, 211. In rocker arm 7, the oil pressure directly acts on locking pin 91 so that it retracts inside the rocker shaft 8. In rocker arm 17, oil pressure acts indirectly on the locking pin 201 to retract it inside the rocker arm body 173. Oil pressure acts directly on pressure pin 191 to push locking pin 201 to retract.

Figure 1B:
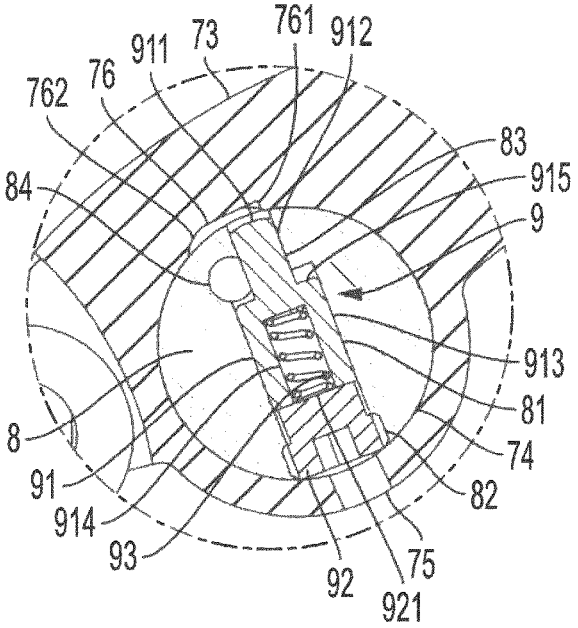
Figure 1C:
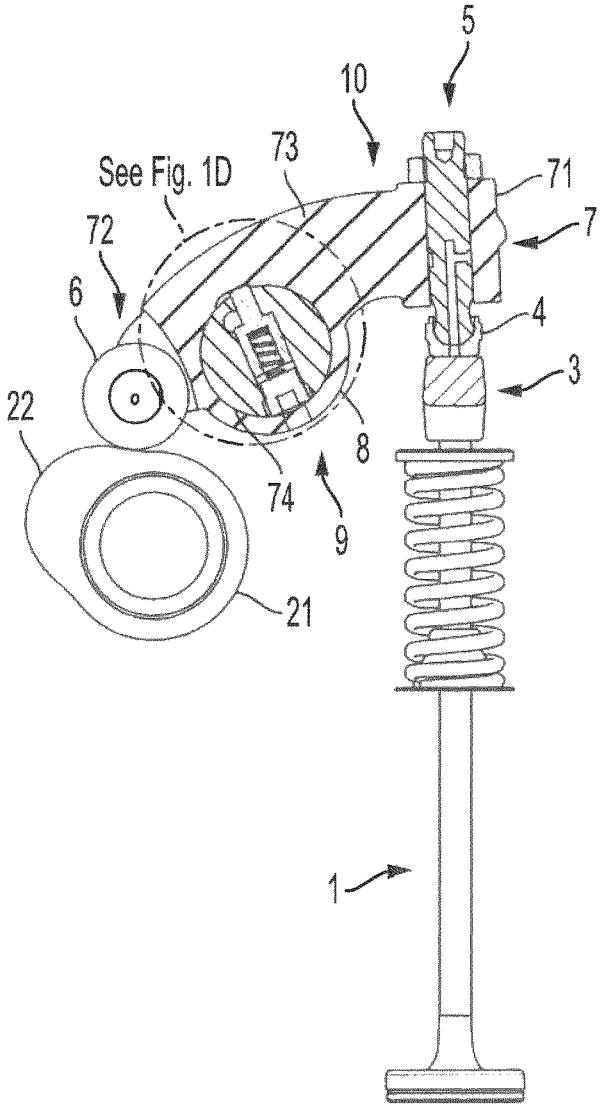
Figure 1D:
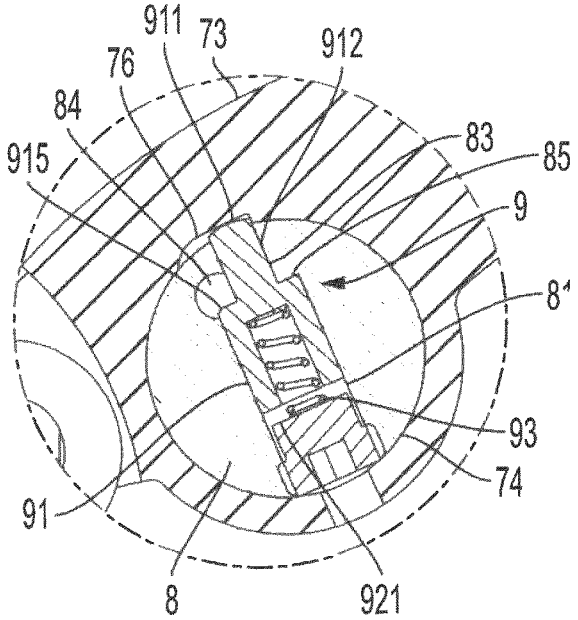
Figure 2A:
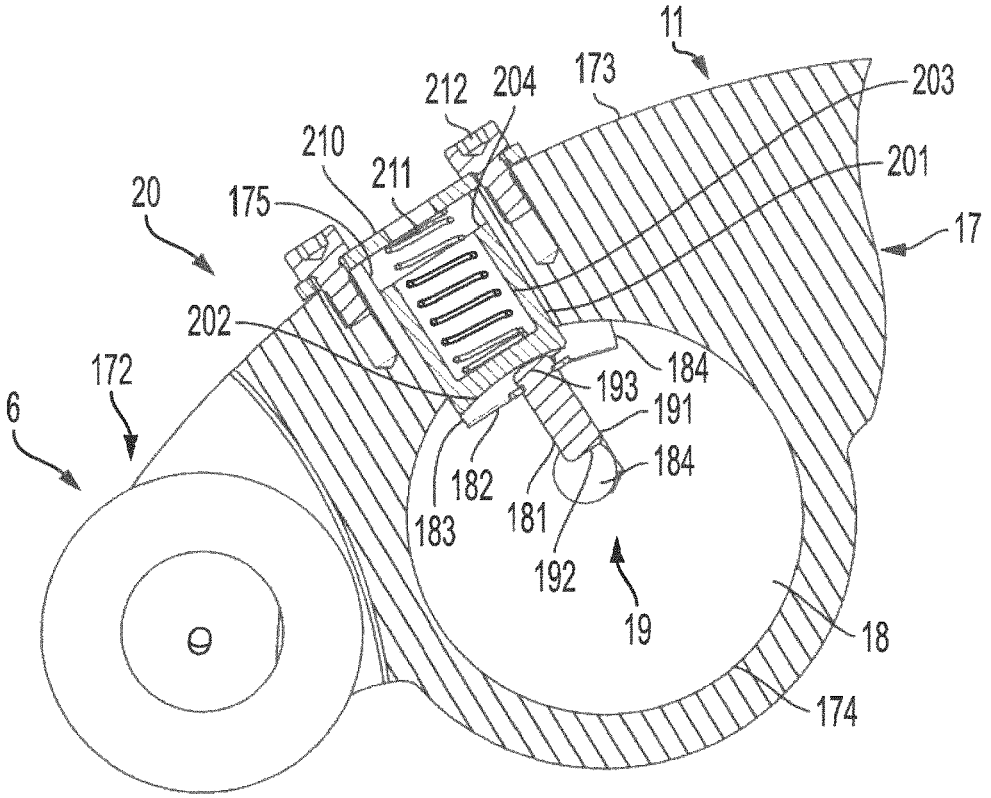
FIGS. 2A-2D illustrate a second rotation-locking mechanism for a second rocker arm assembly.
Figure 2B:
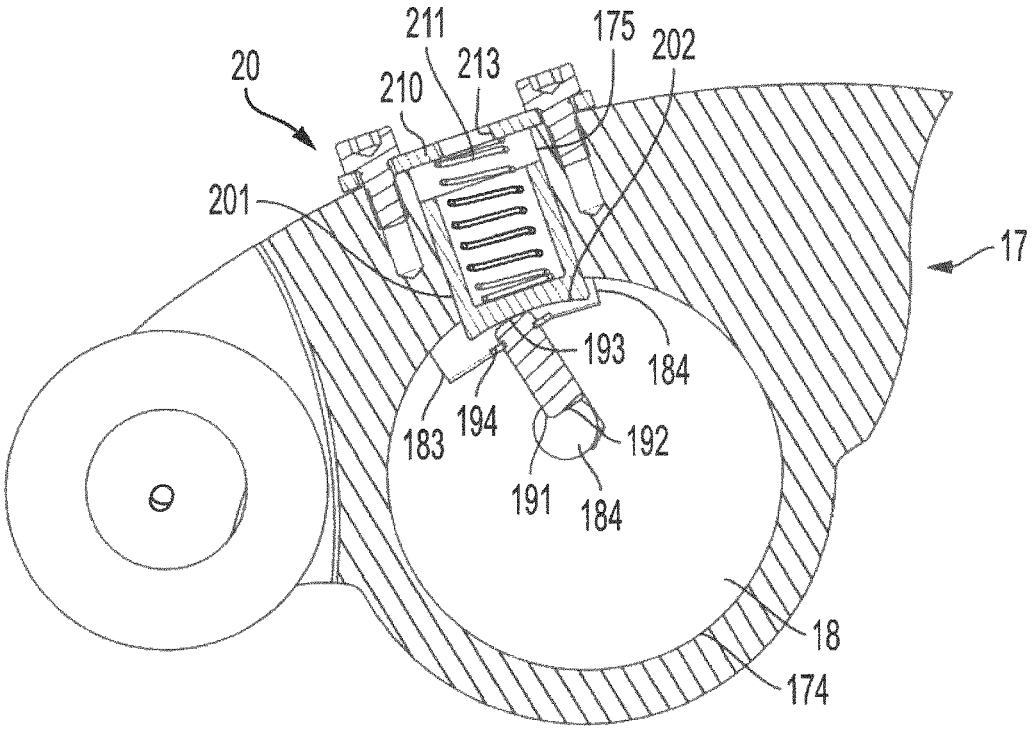
Figure 2C:
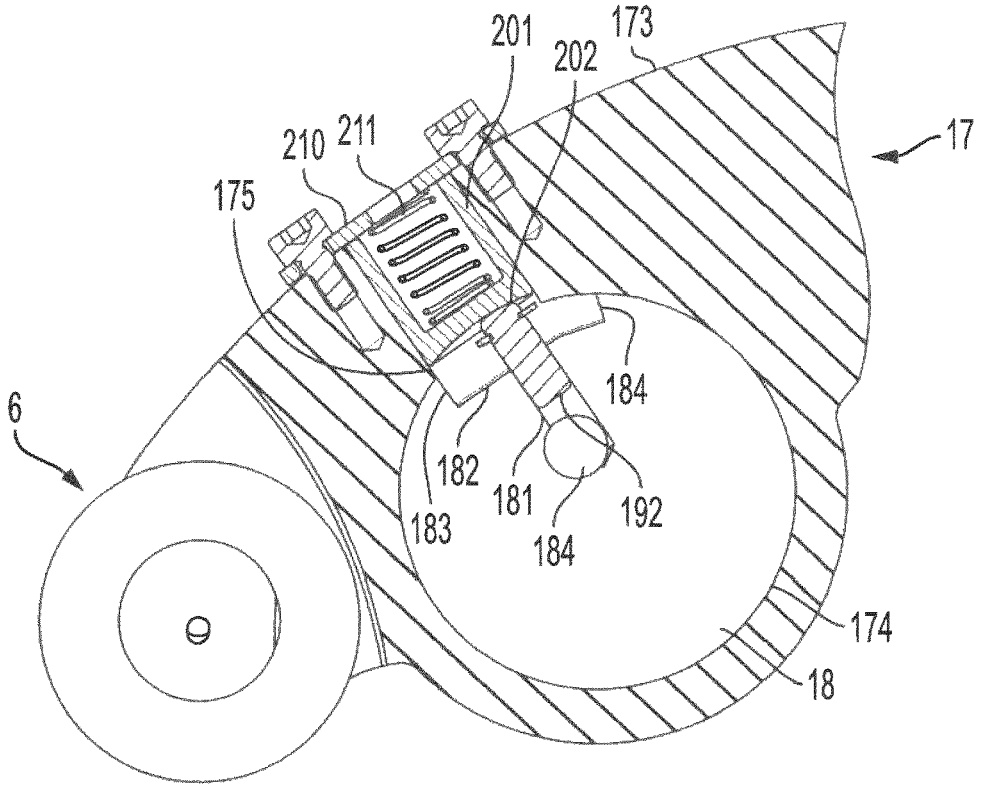
Figure 2D:
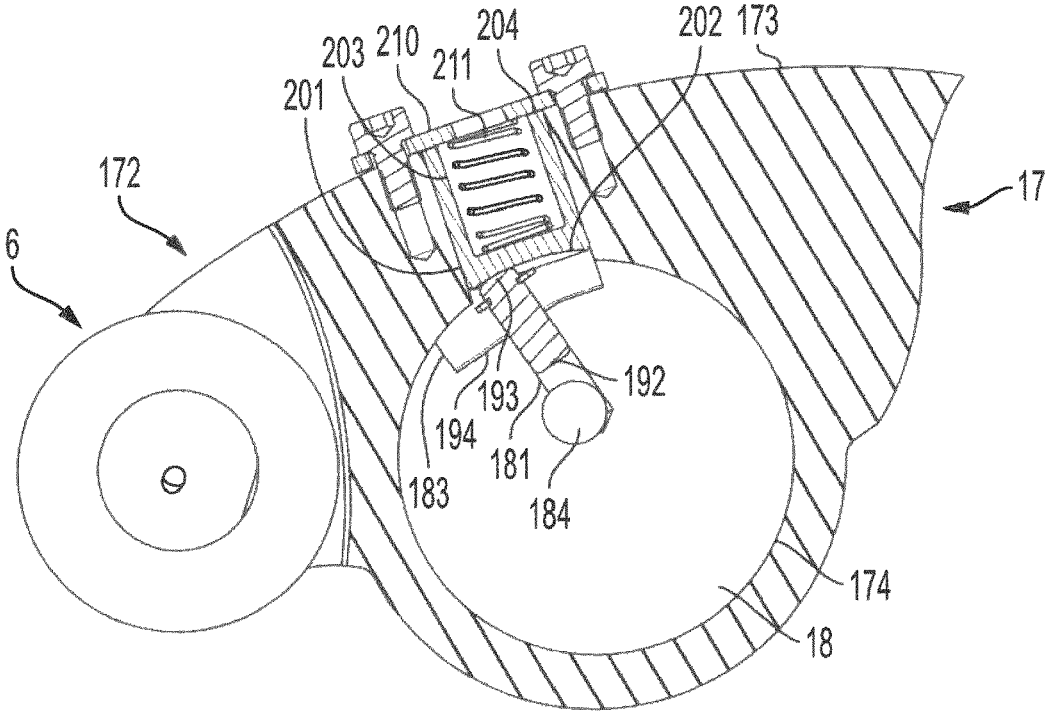

CDC mode can be seen in FIGS. 1C & 1D. FIGS. 1A & 1B show a Standard Engine Operation Mode, which can also be called a nominal lift mode.

Hydraulic control can be provided by supplying a fluid, such as an oil. When oil of predetermined oil pressure high enough to overcome spring 93 is delivered through oil passage 84 in rocker shaft 8, the locking pin 91 is deactivated (unlocked). The position of the oil passage 84 in rocker shaft 8 is chosen to push on locking pin 91 near a large diameter body portion 913. A shoulder 915 can be formed by stepping down from the large diameter body portion 913 to neck portion 912. Neck portion 912 can terminate with a head portion 911. The oil passage can be configured to push on the shoulder 915 of the locking pin 91 to retract the head portion 911 into a channel 83. Unlike the prior art, where the hydraulic control oil floods compartments in the rocker shaft and in rocker arm, the configuration of FIGS. 1A-1D is hydraulically controlled within the rocker shaft 8 and flooding the rocker arm is not required to push the shoulder 915 down. Pressure control is more discrete than the prior art and pressure control is more easily maintained. A pin compartment 81 in the rocker shaft 8 can coextend with the channel 83. Diameter of pin compartment 81 can step down to a smaller diameter of channel 83, thereby forming a travel limit for shoulder 915.

The oil passage 84 can lubricate the locking pin 91 in the channel 83 and pin compartment 81. A plug 92 can be press-fitted, threaded, or otherwise secured to pin compartment 81. Plug 92 can be stationary in the rocker shaft 8 to form a platform 921 against which the spring 93 seats. Spring 93 pushes in spring cup 914 to bias the locking pin 91 in a direction away from plug 92. But, with the predetermined oil pressure supplied in oil passage 84 and pushing the locking pin 91 to the platform 921, the locking pin 91 is retracted and rocker arm 7 is configured for its full range of motion. Valve lift and lowering opens and fully closes the cylinder.

To enable CDC mode, the oil pressure is low due to lowered RPMs of the engine (start-up, coast, shut-down, cylinder deactivation, hybrid operation, etc.). Or, oil pressure is low due to control of an oil control valve connected to oil passage 84. The oil pressure is then not sufficient to overcome spring force of spring 93, so spring 93 pushes the head 911 and some of neck portion 912 out of channel 83. Spring 93 pushes locking pin 91 away from plug 92 and in a direction out of the rocker shaft 8. Head 911 is pushed into locking groove 76.

A leak path can be formed to relieve oil pressure through oil port 75 in body 73. Clearance between rocker shaft bore 74 and rocker shaft 8 permits a controlled leakage to oil port 75. Rocker arm body 73 includes the rocker shaft bore 74 for the rocker shaft 8. A locking groove 76 is formed in the rocker arm body 73. Locking groove 76 can comprise a limiting end 761 to serve as a travel limit for neck 912. Head 911, being crowned (rounded or smoothed), can slide in locking groove 76 when locking pin 91 is extended. A ramp 762 can be formed in the locking groove 76 opposite the limiting end 761. Ramp 762 can be formed such that when the rocker arm 7 rotates in response to lift mode 22, head 911 can slide over and past the ramp 762 to retract the locking pin 91 into the rocker shaft 8 for full (nominal) valve lift. But, limiting end 761 is formed such that head 911 cannot slide on limiting end 761. Instead, neck 912 abuts limiting end 761 to restrict the rotation of the rocker arm 7. Even if the cam 2 returns to base circle 21 the rocker arm 7 is caught against limiting end 761 and rotation-locking mechanism 9 so that the valve 1 cannot return to a fully closed position. The cylinder is propped open to relieve charge or exhaust pressure in the cylinder and their resistance to piston motion within the cylinder is alleviated.

When rocker arm 7 is on base circle 21, limiting end 761 of locking groove 76 prevents the locking pin 91 from fully retracting. The locking pin 91 can resist retracting into channel 83 absent predetermined oil pressure. Neck 912 and limiting end 761 can have sufficient contact friction to resist retracting the locking pin 91 until the predetermined oil pressure is reached. Retraction and subsequent engagement of locking pin 91 can occur once lift mode 22 moves the rocker arm 7 to open valve 1 for desired lift. The motion of head 911 past ramp 762 can be a contributing force to position shoulder 915 with respect to oil path 84 so that the predetermined oil pressure can act on shoulder 915 and maintain the locking pin 91 in the deactivated (unlocked) position.

Groove 76 can be kept small, with an extent formed to correspond to the lift height desired for CDC mode, which can be on the order of one or a few millimeters. The extent can be large enough to accommodate head 911 and provide the CDC mode valve lift. Yet, the extent is kept small compared to the prior art because a large oil pressure build-up is not needed in the rocker arm 7. A small groove 76 is used to move the locking pin 91 to deactivate (unlock). The groove 76 is not used to pressurize the locking pin 91 to move, though a leakage path can be formed in the groove 76 and a residual oil pressure can build in the groove 76. Instead, the primary locking pin 91 deactivating oil pressure is provided within the rocker shaft 8 in the narrow diameter oil path 84 that is aligned to push on shoulder 915. Compared to the prior art, a large hole is not needed in the rocker shaft 8 nor in the rocker arm 7 for oil pressure to build. Oil pressure control is more compact, less lossy, and easier to provide to the oil path 84. The oil path 84 can be contained within the rocker shaft 8 to provide the deactivating oil pressure within the rocker shaft 8. Other than bleed-off/leakage, the oil path 84 does not fluidly communicate with the rocker arm 7 to deactivate (unlock) the locking pin 91. Now, the rocker shaft 8 can comprise additional cross-drilling for other features like oil control to the rocker arm 7 for hydraulic lash or capsules in the valve end 71. Efficient use of oil in the oil path 84 limits sump size, reduces pressurization problems, and allows for pump pressure to build quickly.

It can be said that a rocker arm assembly 10 comprises a rocker arm 7, a rocker shaft 8, and a rotation-locking mechanism 9. Rocker arm can comprise a body 73 comprising a rocker shaft bore 74, a valve end 71 extending from the body 73, and a force-receiving portion. Force-receiving portion can be a cam-receiving end 72 comprising a roller 6 or tappet. Or, force-receiving end can comprise a shelf or ledge or other surface upon which another device acts to rotate the rocker arm 7.

Rocker shaft 8 can comprise a channel 83 that can be stepped to comprise an additional pin compartment 81. An oil path 84 can be enclosed in the rocker shaft 8. The oil path 84 can be configured to supply hydraulic pressure within the rocker shaft 8 to the channel 83. By being within the rocker shaft 8, the hydraulic fluid supplied by the oil path 84 does not exit the rocker shaft and re-enter it to actuate the rotation-locking mechanism 9.

Rotation-locking mechanism 9 can comprise a locking pin 91 (FIGS. 1A-1D) or a pressure pin 191 (FIGS. 2A-2D) configured to slide in the channel 83 or 181. In the rocker shaft 8, the oil path 84 is configured to supply oil pressure to the locking pin 91 within the rocker shaft 8. It can be said that the hydraulic pressure supplied by oil path 84 acts directly on the locking pin 91 because the channel 83 and oil path 84 overlap within the rocker shaft 8. The locking pin 91 can be flush against the channel 83 so that a separate flow path through the rocker arm 7 or rocker shaft 8 is not needed to provide hydraulic pressure to the locking pin 91. Hydraulic pressure does not need to enter the rocker arm 7 to supply pressure to the locking pin 91.

The channel 83 can be stepped to comprise a pin compartment 81 and a plug compartment 82. A limiting edge 85 can be formed. Locking pin 91 can comprise a shoulder 915 configured to fluidly couple to the oil path 84. Shoulder 915 can abut limiting edge 85 to restrict the pressure applied by locking pin 91 on rocker arm 7 or to restrict the travel of locking pin 91 into groove 76. The overlap of channel 83 and oil path 84 can result in having less burs and finishing work when forming limiting edge 85 and channel 83. A large diameter body portion 913 can be flush against the pin compartment 81 to limit hydraulic pressure leakage and thereby limit the amount of hydraulic fluid needed to actuate the locking pin 91. Neck portion 912 can also be flush against channel 83 for like reasons.

A plug 92 can be pressed, threaded, or otherwise secured to plug compartment 82. A spring 93 can be biased against a surface 921 of the plug 92 and can be biased within a spring compartment 914 to push the locking pin 91 out of the rocker shaft 8. Spring 93 can bias the locking pin 91 out of the rocker shaft 7.

The rocker arm 7 can comprise a groove 76 in the rocker shaft bore 74. Locking pin 91 can be configured to slide in the channel 83 between a locked position, where the locking pin 91 abuts the groove 76 (FIGS. 1C & 1D), and an unlocked position, where the locking pin 91 is withdrawn into the channel 83 (FIGS. 1A & 1B). A portion of the groove 76 can be ramped via ramp 762 to press on the locking pin 91 when the rocker arm 7 rotates on the rocker shaft 8. And, a portion of the groove 76 can be configured via limiting end 761 to abut the locking pin 91 to prevent the rocker arm 7 from rotating on the rocker shaft 8.

Locking pin 91 is controlled via hydraulic pressure in oil path 84 to either: keep the valve(s) 1 open and the rocker arm 7 unable to reach base circle 21 (no oil pressure and spring 93 extends locking pin 91); Or, allow full rotation of the rocker arm 7 on rocker shaft 8 to follow lift mode 22 and base circle 21 (hydraulic pressure to shoulder 915 to withdraw locking pin 91).

FIGS. 2A-2D show an alternative rotation-locking mechanism 19 in a rocker arm assembly 11 comprising a rocker arm 17 and a rocker shaft 18. Rocker arm 17 can similarly comprise alternatives as rocker arm 7. Rocker arm 17 at least comprises a body 173 comprising a rocker shaft bore 174, a valve end extending from the body 173, and a force-receiving portion. Force-receiving portion can be a cam-receiving end 172 comprising a roller 6 or tappet. Or, force-receiving end can comprise a shelf or ledge or other surface upon which another device acts to rotate the rocker arm 17.

Rocker shaft 18 can comprise a channel 181 and an oil path 184 enclosed in the rocker shaft 18. The channel 181 and oil path 184 can be said to be enclosed in the rocker shaft 18. The oil path 184 can be configured to supply hydraulic pressure within the rocker shaft 18 to the channel 181. A rotation-locking mechanism 19 can comprise a pressure pin 191 configured to slide in the channel 181. The oil path 184 can be configured to supply oil pressure to the pressure pin 191 within the rocker shaft 18. The pressure pin 191 can be actuated by the oil path 184 without the hydraulic pressure exiting the rocker shaft 18. The oil path 184 can directly act on the pressure pin 191. It can be said that the channel 181 and oil path 184 overlap within the rocker shaft 18. Unlike the prior art, where the hydraulic control oil floods compartments in the rocker shaft and in rocker arm, the configuration of FIGS. 2A-2D is hydraulically controlled within the rocker shaft 18 and flooding the rocker arm is not required to actuate the pressure pin 191 to move locking pin 201. Pressure control is more discrete than the prior art and pressure control is more easily maintained.

Pressure pin 191 can comprise an oil pressure end 192 for receiving hydraulic pressure from oil path 184 and can comprise a rounded sliding end 193 for sliding against a locking pin 201 in the rocker arm 17. Pressure pin 191 can be flush against the channel 181 to limit leakage of hydraulic pressure and thereby limit the amount of hydraulic fluid needed to pressurize the pressure pin 191.

The rocker arm assembly 11 comprising the pressure pin 191 can further comprise a locking groove 182 in the rocker shaft 18. Locking groove 182 can be bounded by limiting ends 183, 184 that limit the travel of locking pin 201 in the rocker shaft 18. Similar to the above, the locking groove 182 can be kept small to limit the amount of hydraulic fluid leaking and traversing in the system. Locking groove can be large enough to receive the locking pin 201 and to provide the desired cylinder decompression.

Locking pin 201 in the rocker arm 17 is biased to engage the locking groove 182. Locking pin 201 in the rocker arm 17 is biased to push the pressure pin 191 towards the oil path 184. Pressure pin 191 can be configured to comprise a travel limit, such as a snap ring 194 or washer or the like, configured to catch in the locking groove 182 to restrict the travel of the pressure pin 191 towards the oil path 184. Locking pin 201 of locking pin assembly 20 in the rocker arm 17 can comprise a sliding surface 202 against which the sliding end 193 of pressure pin 191 is configured to slide.

A locking pin bore 175 can be formed in or through the rocker shaft 17 as a through-hole or blind bore. In the case of a through-hole, a plate 210 can be mounted over the locking pin bore 175 with screws 212 or other fasteners. A spring 211 can be biased against the plate 210 and a spring compartment 203 in the locking pin 201 in the rocker arm 17. A pressure port 213 can be formed in the plate 210. Plate 210 can also form a travel limit for locking pin 201. An end 204 of locking pin 201 can travel until it reaches plate 210 to prevent the over-extension of pressure pin 191.

Locking pin 201 in the rocker arm 17 can be configured to slide in the rocker arm 17 between a locked position, where the locking pin 201 in the rocker arm 17 abuts the locking groove 182, and an unlocked position, where the locking pin 201 in the rocker arm 17 is withdrawn into the rocker arm 17. A portion of the locking groove 182 can be configured, as with limiting end 183, 184, to abut the locking pin 201 in the rocker arm 17 to prevent the rocker arm 17 from rotating on the rocker shaft 18.

Locking pin 201 in rocker arm 18 comprises spring 211 pushing the locking pin 201 into a locking groove 182, which can be a slot or bore, on a rocker shaft 18. This locked, or latched pin position, enables angular motion of the rocker arm 17, but in limited range. The valve(s) 1 can be fully opened (corresponding to a cam profile such as lift mode 22), but due to limited rocker arm 17 motion, valve(s) 1 cannot be closed. During valve(s) 1 closing, the rocker arm 17 sits on the locking pin 201 and keeps the roller 6 above the cam 2 and keeps valve(s) 1 slightly open. CDC mode is on. CDC mode can be turned off to facilitate drive mode and full cam lobe profile use of base circle 21 and lift mode 22 as by pressurizing pressure pin 191 via oil path 184. Hydraulic pressure to pressure pin 191 overcomes spring force of spring 211 and pushes locking pin 201 to withdraw into locking pin bore 175.

The pressure pin 191 can be actuated by oil pressure to provide the hydraulic pressure. There are at least two ways to control the oil pressure: 1) by an engine oil pump 2) by an oil control valve (while the pump is on).

If CDC is used for a start/stop system, an oil pressure can be controlled in a simple fashion by the engine pump. A running engine has enough oil pressure to keep the locking pin 201 unlatched, therefore valve(s) 1 are in drive mode. While the engine is stopping, the pump is slowing down, and the pressure is decreasing. Then, the spring 211 can overpower the pressure pin 191 to lock the locking pin 201. Rocker arm 17 movement is reduced and valve(s) 1 are in CDC mode. While the engine is starting, the oil pressure is increasing, eventually overpowering the spring 211. The engine can start in CDC mode and transition to drive mode as the oil pressure increases. If a different management of the CDC is required, such as for active engine braking, platooning, or coasting, an oil control valve (OCV) can be used for pressure control. The OCV can get electrical signals from an onboard computing device such as an electronic control unit ("ECU").

The configurations are suitable for most heavy-duty engines with various valvetrain layouts. Minor or no design changes are needed by OEMs installing the rocker arm assembly in their valvetrain.

Other implementations will be apparent to those skilled in the art from consideration of the specification and practice of the examples disclosed herein.

What is claimed is:

1. A rocker arm assembly, comprising:
a rocker arm comprising:
a body comprising a rocker shaft bore;
a valve end extending from the body;
a force-receiving portion; and
a locking pin;
a rocker shaft comprising:
a channel;
a locking groove;
a rotation-locking mechanism comprising a pressure pin, the rotation-locking mechanism positioned within the channel and movable between a locked position and an unlocked position; and
an oil path configured to supply oil to the locking pin or the pressure pin within the rocker shaft to move the rotation-locking mechanism between the locked position and the unlocked position, wherein the entire oil path is enclosed in the rocker shaft,
wherein the locking pin is biased to engage the locking groove, and
wherein the pressure pin further comprises a travel limit configured to catch in the locking groove to restrict a travel of the pressure pin towards the oil path.

2. The rocker arm assembly of claim 1, wherein the channel and the oil path overlap within the rocker shaft.

3. The rocker arm assembly of claim 1, wherein the locking pin in the rocker arm is biased to push the pressure pin towards the oil path.

4. The rocker arm assembly of claim 1, wherein the locking pin in the rocker arm comprises a sliding surface against which the pressure pin is configured to slide.

5. A rocker arm assembly, comprising:
a rocker arm comprising:
a body comprising a rocker shaft bore;
a valve end extending from the body;
a force-receiving portion; and
a locking pin;
a rocker shaft comprising:
a locking groove, wherein the locking pin is biased to engage the locking groove;
a channel; and
an oil path enclosed in the rocker shaft, the oil path configured to supply hydraulic pressure within the rocker shaft to the channel; and
a rotation-locking mechanism comprising a pressure pin configured to slide in the channel,
wherein the oil path is configured to supply oil pressure to the pressure pin within the rocker shaft, and
wherein a portion of the locking groove is configured to abut the locking pin in the rocker arm to prevent the rocker arm from rotating on the rocker shaft.

6. A rocker arm assembly, comprising:
a rocker arm comprising:
a body comprising a rocker shaft bore;
a valve end extending from the body;
a force-receiving portion; and
a locking pin;
a rocker shaft comprising:
a locking groove, wherein the locking pin is biased to engage the locking groove;
a channel; and
an oil path enclosed in the rocker shaft, the oil path configured to supply hydraulic pressure within the rocker shaft to the channel; and
a rotation-locking mechanism comprising the locking pin or a pressure pin configured to slide in the channel,
wherein the oil path is configured to supply oil pressure to the locking pin or the pressure pin within the rocker shaft,
wherein the locking pin of the rocker arm is configured to slide in the rocker arm between a locked position, where the locking pin in the rocker arm abuts the locking groove, and an unlocked position, where the locking pin in the rocker arm is withdrawn into the rocker arm.

7. A rocker arm assembly, comprising:
a rocker arm comprising:
a body comprising a rocker shaft bore;
a valve end extending from the body;
a force-receiving portion; and
a locking pin;
a rocker shaft comprising:
a locking groove, wherein the locking pin is biased to engage the locking groove;
a channel; and
an oil path enclosed in the rocker shaft, the oil path configured to supply hydraulic pressure within the rocker shaft to the channel; and
a rotation-locking mechanism comprising the locking pin or a pressure pin configured to slide in the channel,
wherein the oil path is configured to supply oil pressure to the locking pin or the pressure pin within the rocker shaft,
wherein the rocker arm assembly further comprises a locking pin bore through the rocker shaft, a plate mounted over the locking pin bore, and a spring biased against the plate and the locking pin in the rocker arm.

* * * * *